US009409635B2

(12) United States Patent
Leeuwenburgh

(10) Patent No.: US 9,409,635 B2
(45) Date of Patent: Aug. 9, 2016

(54) TOW BAR HOLDER

(71) Applicant: Peter Leeuwenburgh, BA Herwijnen (NL)

(72) Inventor: Peter Leeuwenburgh, BA Herwijnen (NL)

( * ) Notice: Subject to any disclaimer, the term of this patent is extended or adjusted under 35 U.S.C. 154(b) by 0 days.

(21) Appl. No.: 14/410,802

(22) PCT Filed: Jun. 25, 2013

(86) PCT No.: PCT/EP2013/063294
§ 371 (c)(1),
(2) Date: Dec. 23, 2014

(87) PCT Pub. No.: WO2014/001343
PCT Pub. Date: Jan. 3, 2014

(65) Prior Publication Data

US 2015/0144048 A1 May 28, 2015

(30) Foreign Application Priority Data

Jun. 28, 2012 (DE) ..... 10 2012 211 165

(51) Int. Cl.

| | |
|---|---|
| ***B63B 21/04*** | (2006.01) |
| ***B63B 35/81*** | (2006.01) |
| *B63B 7/08* | (2006.01) |
| *B63H 20/02* | (2006.01) |
| *B63H 20/06* | (2006.01) |

(52) U.S. Cl.
CPC ..... *B63B 35/816* (2013.01); *B63B 7/087* (2013.01); *B63H 20/02* (2013.01); *B63H 20/06* (2013.01)

(58) Field of Classification Search
CPC ..... B63B 35/816
USPC ..... 114/253
See application file for complete search history.

(56) References Cited

U.S. PATENT DOCUMENTS

| | | | | |
|---|---|---|---|---|
| 2,907,295 | A | 10/1959 | Delaney | |
| 2,920,598 | A * | 1/1960 | Nielsen | B63B 35/816 114/253 |
| 7,798,087 | B2 * | 9/2010 | Leeuwenburgh | B63B 35/815 114/253 |

FOREIGN PATENT DOCUMENTS

| | | |
|---|---|---|
| EP | 1993904 B1 | 4/2012 |
| WO | 2007097620 A1 | 8/2007 |

OTHER PUBLICATIONS

International Search Report dated Sep. 20, 2013 for PCT application No. PCT/EP2013/063294.

(Continued)

*Primary Examiner* — Stephen Avila
(74) *Attorney, Agent, or Firm* — Ohlandt, Greeley, Ruggiero & Perle, LLP

(57) ABSTRACT

A tow bar holder for securing a tow bar to a boat having an outboard engine has two separate securing elements secured to the stern of the boat. The securing elements each have a fixing element for securing to an engine plate, and a receiving element. The feet of the tow bar can be plugged into a receiving space of the receiving element. In this case, the internal dimensions of the receiving space are larger than the external dimensions of the feet of the tow bar, such that the tow bar is tiltable and/or is fixable in various positions in the receiving space.

17 Claims, 7 Drawing Sheets

(56) References Cited

OTHER PUBLICATIONS

English translation of the Written Opinion of the International Searching Authority dated Dec. 31, 2014 for International Application No. PCT/EP2013/063294.

English translation of the International Preliminary Report on Patentability of the International Searching Authority dated Dec. 31, 2014 for International Application No. PCT/EP2013/063294.

* cited by examiner

TOW BAR HOLDER

BACKGROUND

1. Field of the Disclosure

The disclosure relates to a tow bar holder for fastening a tow bar to a boat with an outboard engine.

2. Discussion of the Background Art

Such tow bars are fastened to the stern of a boat with an outboard engine for the purpose of towing water-skiers and the like. The tow bar holders have a portion bent outward with respect to the stern of the boat, which is connected, in particular integrally formed with bar feet. A tow rope is connected with the curved portion which is substantially horizontal when a water-skier or the like is towed. The tow rope is adapted to be shifted sideways in the curved portion or to slide in this portion.

A tow bar holder of this kind is known from EP 1 993 904. This tow bar holder comprises two mounting elements to be fastened to a boat's stern. Each mounting element has a fixing element fastened to the stern of a boat, in particular the motor plate. For this purpose, the fixing element has a leg abutting on the engine plate and a leg extending substantially vertically with respect to the engine plate. A plate is held pivotably on the leg extending vertically with respect to the engine plate. A respective receiving element is connected with the plate, the element being a cylindrical tube. The tubular receiving element forms a receiving space for insertion of one tow bar foot, respectively. The plate, and thus the receiving element fixedly connected with the plate, is pivotable so that, for instance, in use of the towing device, the tow bar is oriented substantially horizontally regardless of the position of the boat in the water. For this purpose, the plate is connected with the fixing element via a pintle. Further, the plate has a curved slot. The same coincides at least partly with a slot provided in the fixing element leg extending vertically with respect to the bottom plate. A stop pin is inserted through both slots and is adapted to be fixed in the plate at different positions. Due to the stop pin and the two, at least partly overlapping slots, a pivot angle of the tow bar of about 30° can be set.

The tow bar holder described in EP 1 993 904 B1 is a multipart and thus heavy component. Furthermore, it is necessary to provide a friction element between the fixing element and the plate, which friction element undergoes wear.

It is an object of the present disclosure, to provide a compact, reliable tow bar holder having a simple structure.

SUMMARY

The tow bar holder of the present disclosure for fastening a tow bar to a boat with an outboard engine has two separate securing elements adapted to be fastened to the stern of a boat. The securing elements serve to receive the two tow bar feet. Each securing element comprises an in particular plate-shaped fixing element. Using the fixing element, the securing element is fastened to the stern of a boat, in particular to an engine plate. Preferably, the fastening is achieved by means of screws. In this regard, the fixing element can have in particular a plurality of mounting bores through which the screws are passed which are then fixed in the engine plate. By providing a plurality of bores, in particular superposed bores, it is possible to adjust the fixing element on the engine plate in a standardized manner. A receiving element is connected with the fixing element. Here, owing to the design of the receiving element provided by the disclosure, it is possible to fixedly arrange the receiving element on the fixing element. The tow bar holder of the present disclosure does not require a complexly designed mobility or pivotability between the fixing element and the receiving element. According to the disclosure, the receiving elements each have a receiving space for insertion of one tow bar foot, respectively. Here, the inner dimensions of the receiving space are larger than the outer dimensions of the tow bar feet. Thereby, it is possible for the tow bar to be moved and/or fixed at different positions in the receiving space. In particular, the inner dimensions of the receiving space are larger in the longitudinal direction of the boat that the outer dimensions of the tow bar feet. Thereby, it is possible to displace and/or tilt the tow bar. Preferably, the inner dimensions of the receiving space, seen in the longitudinal direction of the boat, are larger than the outer diameters of the tow bar feet, seen in the longitudinal direction of the boat, by at least 10 mm, in particular by at least 20 mm, and particularly preferred by at least 30 mm.

According to the disclosure, the tow bar feet are thus movable or tiltable in the longitudinal direction of the boat within the receiving space. This, in particular, makes it possible to fixedly connect the receiving elements with the fixing elements so that a complex structure using a pivotable intermediate plate, as described in EP 1 993 903 B1, is not required.

The receiving spaces preferably have a width transverse to the longitudinal direction of the boat, which substantially corresponds to the width of the tow bar feet. Thus, seen in a direction transverse to the longitudinal direction of the boat, the tow bar has no or only little play, this possibly little play serving merely to facilitate the insertion and removal of the tow bar feet into or from the receiving space.

In a particularly preferred embodiment the receiving spaces have a generally rectangular cross section. In particular, the receiving spaces are delimited by two side walls extending substantially in parallel with the longitudinal direction of the boat. Here, the two tow bar feet are each arranged between the two side walls of the receiving element.

It is particularly preferred to provide a retaining element connected with the respective receiving element, in particular in a releasable manner. The retaining element provided per fastening element, which in particular is a retaining bolt, prevents the tow bar from slipping out of the receiving elements. In this regard, it is preferred that the ends of the tow bar have an opening or notch into which the retaining element engages. It is particularly preferred to design the retaining elements as retaining bolts. In a preferred embodiment, at least one of the two side walls, preferably both side walls respectively have one opening through which the retaining element can be passed. In particular, the opening in at least one of the two side walls, and preferably in both side walls, is closed. This guarantees optimal force absorption and the retaining element is prevented from slipping out of the closed openings in one or both side walls. It is preferred that each of the ends of the tow bar also has an opening in particular a round opening. The openings, provided in particular in both side walls, are preferably arranged opposite each other, where it is particularly preferred that the two openings are slot-shaped. If the openings are slot-shaped, it is provided in particular that the openings are shaped as closed slots so as to guarantee the mobility of the retaining element in the slots, but also to prevent them from slipping out of the slots. The slots generally extend in the longitudinal direction of the boat and may be curved. Owing to the slot-shaped design of the openings in the two side walls, it is possible to move the retaining element, in particular the retaining bolt, in the openings substantially in the longitudinal direction of the boat, and the mobility of the retaining element, in particular of the retaining bolt, in the opening is increased. The larger the extension of the slot is, in particular in the longitudinal direction of the boat, the greater is the mobility and thus the adjustment range or the tiltability of the bar. Further, it is possible that the retaining elements or the retaining bolts extend in the longitudinal direction. In this regard, a rear wall and a front wall of the receiving element may be provided with an opening or a bore. Similar to the transversely arranged retaining elements, it is again preferred that openings or recesses are formed in the tow bar feet, possibly in the form of elongated holes. At the same time, an inadvertent slipping of the tow bar feet from the receiving spaces is prevented by providing the retaining elements.

In a particularly preferred embodiment, the two securing elements of the tow bar holder are identical in design. This is possible if a securing element is designed such that it is symmetrical e.g. with respect to a centre plane. With such a design of the securing element, the same may be connected with the engine plate as the left or right securing element, seen from the rear of the boat, without changing the orientation of the securing element. In order to form a securing element that is as compact as possible, it is preferred that, when looking at the securing element from the rear of the boat, the fixing elements are arranged laterally beside the receiving element. In particular, the two fixing elements are directed inwards with respect to the receiving elements. In a particularly preferred embodiment, it is possible also with such a design to realize a securing element that can be used equally as a left or right securing element. For this purpose, again seen from the rear side of the boat, the securing element is rotated by 180° about a horizontal longitudinal axis. A securing element arranged as a right securing element, for example, has a fixing element directed to the left side. By turning this securing element by 180°, a left securing element is formed whose fixing element is directed to the right. Bores provided in the fixing element, for example, have to be arranged in a corresponding symmetrical manner. Openings provided in the side walls to receive retaining elements in the receiving element must also be arranged in a corresponding symmetrical manner. Such a design of the securing elements as identical securing elements is not only advantageous with respect to storage and manufacture, but also with respect to assembly, since the risk of erroneous assembly is reduced.

Further, in a particularly preferred embodiment of the disclosure, stop elements are provided on or connected with the receiving element. By providing stop elements, the tiltability of the tow bar can be restricted in the longitudinal direction of the boat. It is particularly preferred that at least one, preferably two upper stop elements are provided. In particular, a front and a rear stop element are provided, seen in the longitudinal direction of the boat. The upper stop elements are arranged in the upper region of the receiving element and thus delimit the displacement or tilting of the tow bar in this region. Preferably, at least one, preferably two lower stop elements are provided in the lower region of the receiving element, where, again, a front and a rear stop element are provided. Thereby, the displacement of the tow bar in the longitudinal direction of the boat is restricted in the lower region of the receiving element. It is particularly preferred that the stop elements are at least partly adjustable. This may be achieved, for instance, by providing eccentrically shaped stop elements, so that by turning the stop elements into different positions a change of position is effected. It is further possible that a boat-side front wall of the receiving element, i.e. a front wall directed towards the boat, and/or a rear wall of the receiving element, which is situated away from the boat, is designed as stop elements.

It is particularly preferred to form at least a part of the stop elements as stop pins. For a change of position of the stop pins, it is then preferred to provide the upper and/or lower portions of the side walls of the receiving element with a plurality of holes in which the stop pins can be fixed in different positions.

The fixing element, which is in particular rigidly connected with the receiving element, may be arranged laterally offset from the receiving element in order to facilitate assembly. It is preferred that the fixing element is formed integrally with a boat-side front wall of the receiving element. As an alternative, the fixing element may also be arranged offset in the longitudinal direction with respect to the boatside front wall. The in particular plate-shaped fixing element is then preferably arranged laterally beside the receiving element. For this reason, the securing element can be designed to be extremely compact. Further, the possible swivel angle of the outboard engine is enlarged. This is especially advantageous with engines having large outer dimensions. Further, it is advantageous that the tow bar is arranged closer to the engine plate.

Specifically in case of a fixing element arranged laterally beside the receiving element, it is preferred that the same has a recess in the lower and/or upper region. Thereby, the stop pins arranged in these regions can be provided in a simple manner. Further, the movement of the retaining element, in particular in the slot-shaped openings of the side walls, is thereby not restricted by the laterally arranged fixing element.

For a further enlargement of the tilting region of the tow bar, a rear wall of the receiving element, averted from the boat, may have a recess in particular in the lower region.

Further, it is preferred to connect the stop elements with damping elements. Thereby, the abutment of the tow bar is dampened so that in particular any damage to the stop elements and/or the tow bar is avoided. If the front wall and/or the rear wall are designed as stop elements in the upper and/or lower region, or serve as stop elements, a stop element made of an elastomeric material, for example, can be fixed on the corresponding inner side of the walls by gluing, for example. With bolt-shaped stop elements, it is possible to surround these with sleeve-shaped damping elements also made of an elastomeric material, for example.

The following is a detailed description of preferred embodiments of the disclosure with reference to the accompanying drawings.

DETAILED DESCRIPTION OF THE PREFERRED EMBODIMENT

Figure 1:
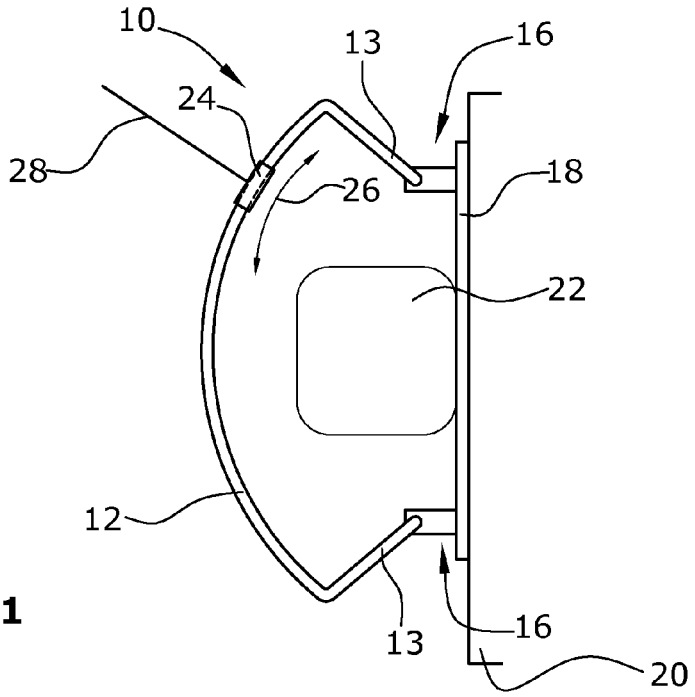
FIG. 1 is a schematic, much simplified top plan view of a tow bar fastened to a boat by means of a tow bar holder.

A tow bar 10 comprises a curved element 12 that is connected with tow bar feet 14 via intermediate elements 13. The two tow bar feet are arranged in securing elements 16. The two securing elements 16 are fastened to an engine plate 18, in particular by means of screws. The engine plate 18 is arranged at the stern 20 of a boat and supports a schematically illustrated outboard engine 22. For example, a roller 24 may be provided in the curved portion, which roller is displaceable along the curved portion 12, as illustrated by the arrow 26. A rope 28 is fastened to the roller 24, which a water-skier may take hold on, for example.

In a first preferred embodiment (FIGS. 2 to 4), the securing elements 16 each have a receiving element 30. The receiving element 30, which in the embodiment illustrated has a rectangular cross section, forms a receiving space 32 into which the tow bar feet 14 (FIG. 5) can be inserted.

In the embodiment illustrated, the receiving element 30 has two opposing side walls 34 extending in the longitudinal direction of the boat. The two side walls 34 are substantially identical in design and each have a retaining slot 36 such that the two retaining slots are arranged opposite each other. A retaining element 38 (FIG. 4), formed as a retaining bolt in the embodiment illustrated, is arranged in the retaining slot, the retaining bolt 38 also being passed through openings in the tow bar foot (FIG. 5).

Further, the receiving elements 30 have a rear wall 40 averted from the stern 20 of the boat. Opposite the rear wall 40, a boat-side front wall 42 is provided. In the preferred embodiment illustrated, a fixing element 44 is integrally connected with the front wall 42. The fixing element 44 preferably comprises a plurality of vertically superposed bores 46. Screws for fixing the fixing element 44 in the engine plate 18 are inserted through these bores 46. It is also possible to arrange the fixing element 44 laterally beside the side wall 34, as illustrated in broken lines in FIG. 3. The fixing element 44 preferably has a recess 48 in the lower region so that the retaining bolt 38 and a stop element, such as a stop pin 50 (FIG. 4), are not impeded by the fixing element 44 with respect to their position and movement.

Figure 2:
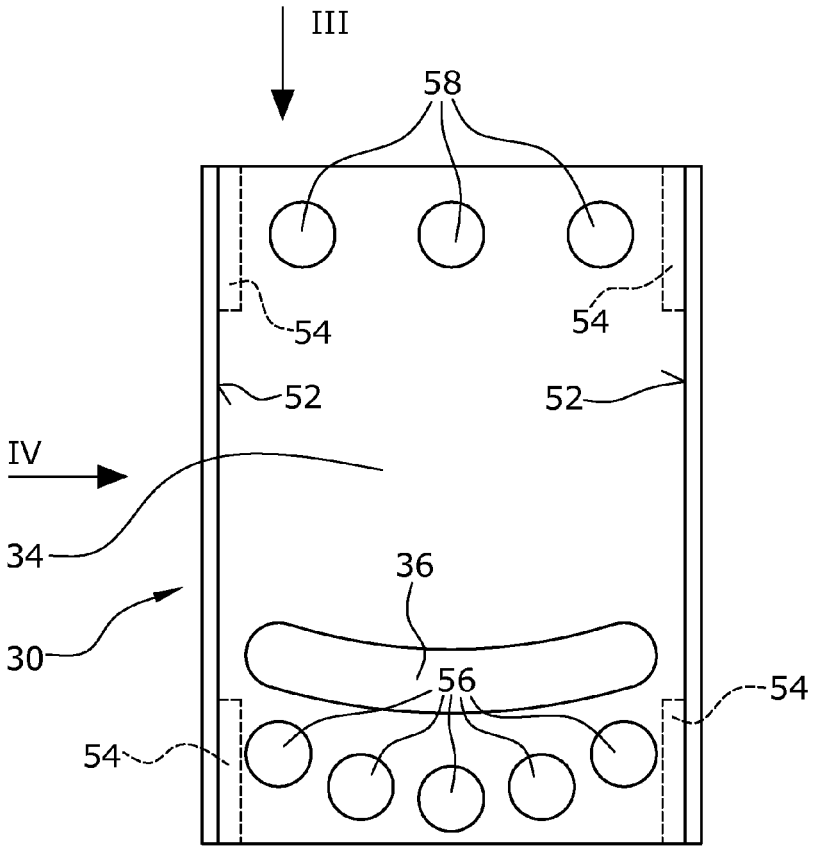
FIG. 2 is a schematic side elevational view of a first embodiment of one of the two securing elements of a tow bar holder.

Moreover, stop elements 54, illustrated in broken lines in FIG. 2, may be arranged on inner sides 52 of the front wall 42 and the rear wall 40.

For the use of the tow bar holder, the two securing elements 16 are fastened to the engine plate 18 via the fixing elements 44, using screws. Thereafter, the two tow bar feet 14 can be inserted into the receiving space 32 of the receiving elements 30 from above. In order to prevent the tow bar from slipping out in the upward direction, two retaining bolts 38 are inserted through the two slot-shaped recesses 36 and a bore in the corresponding tow bar foot 14, and are fixed. Here, the fixing is effected such that a movement of the retaining elements 38 in the slot 36 is possible. Due to the provision of a front wall 42 and a rear wall 40 the tilting range is restricted, as schematically illustrated in FIG. 5.

Figure 9:
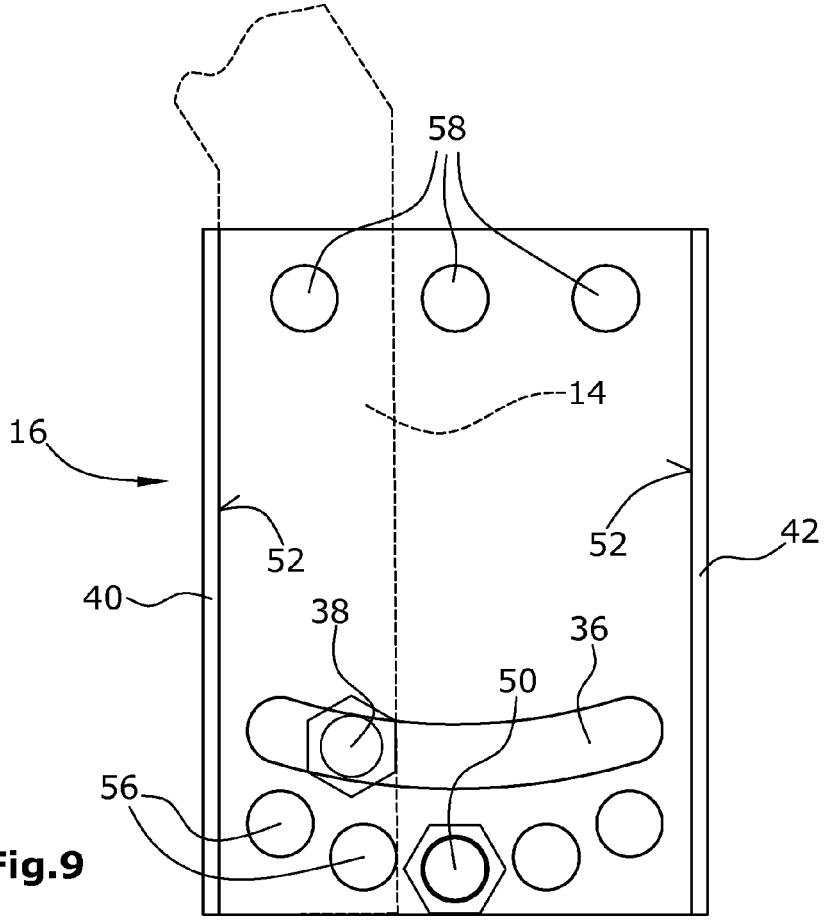
FIG. 9 is a schematical side elevational view of the embodiment illustrated in FIGS. 2 to 4, together with a tow bar in the intermediate driving position.

By providing additional stop elements 50, preferably also formed as bolts or screws, the tilting range can be restricted, as illustrated in FIG. 9, for example. In this regard, the stop elements may be arranged in bores 56 in the lower region of the side wall 34 and/or also in bores 58 in the upper region of the side walls 34. Thus, it is possible to vary/adjust the tilting range.

Figure 6:
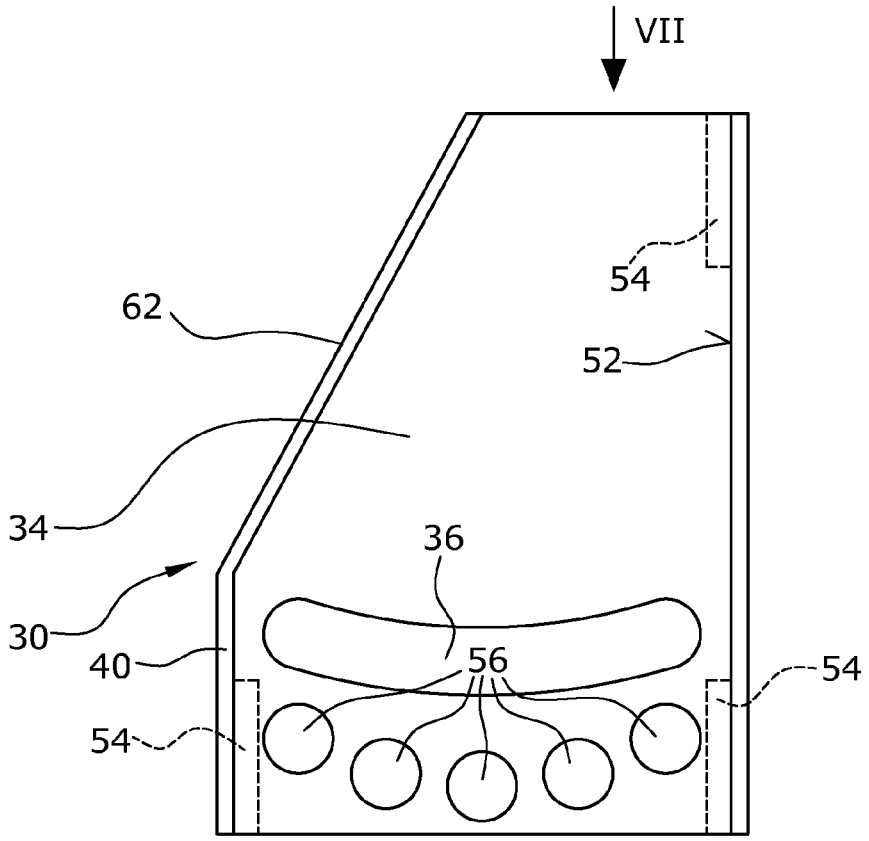
FIG. 6 is a schematical side elevational view of a second embodiment of one of the two securing elements of a tow bar holder.

In another preferred embodiment (FIGS. 6 to 8), similar and identical parts are identified by the same reference numerals.

Figure 3:
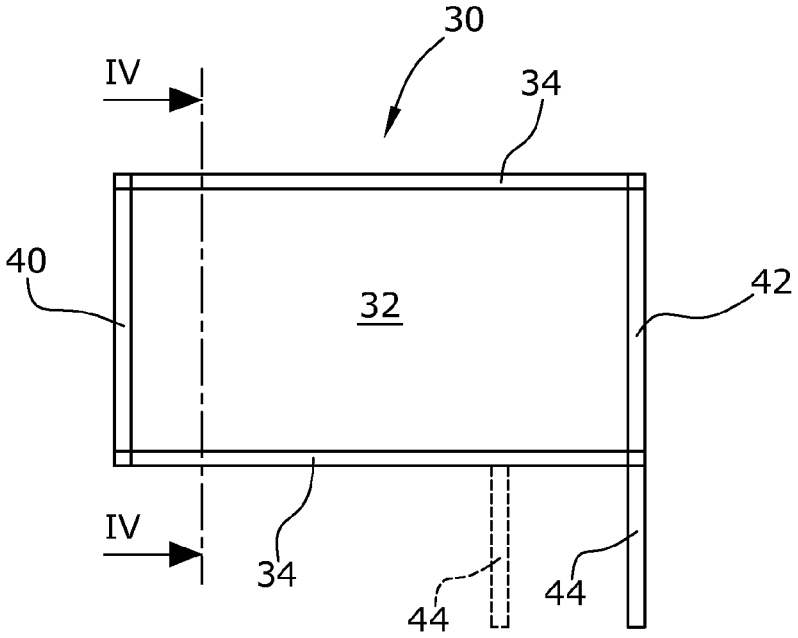
FIG. 3 is a top plan view of the securing element illustrated in FIG. 2, seen in FIG. 4 is a sectional view of the securing element illustrated in FIG. 2, seen along the line IV-IV in FIG. 3.
Figure 4:
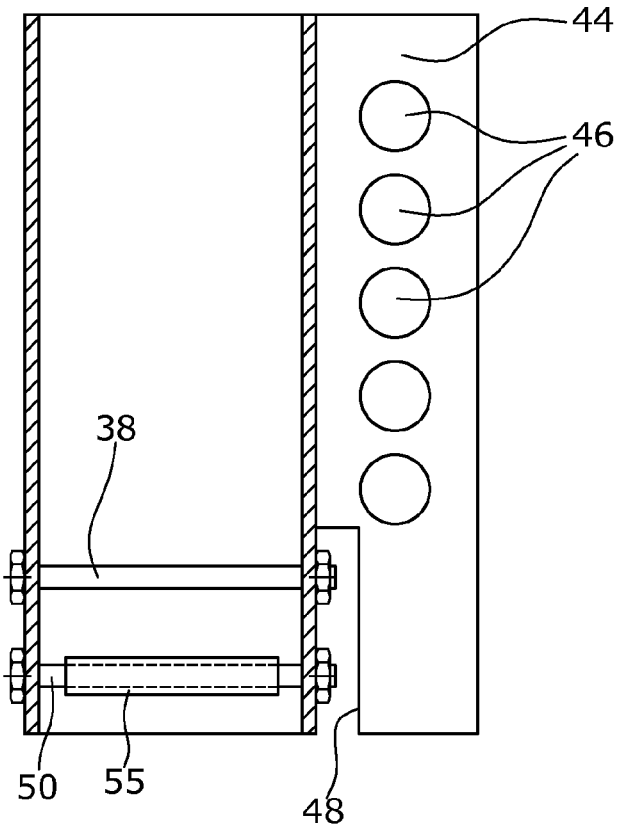
Figure 5:
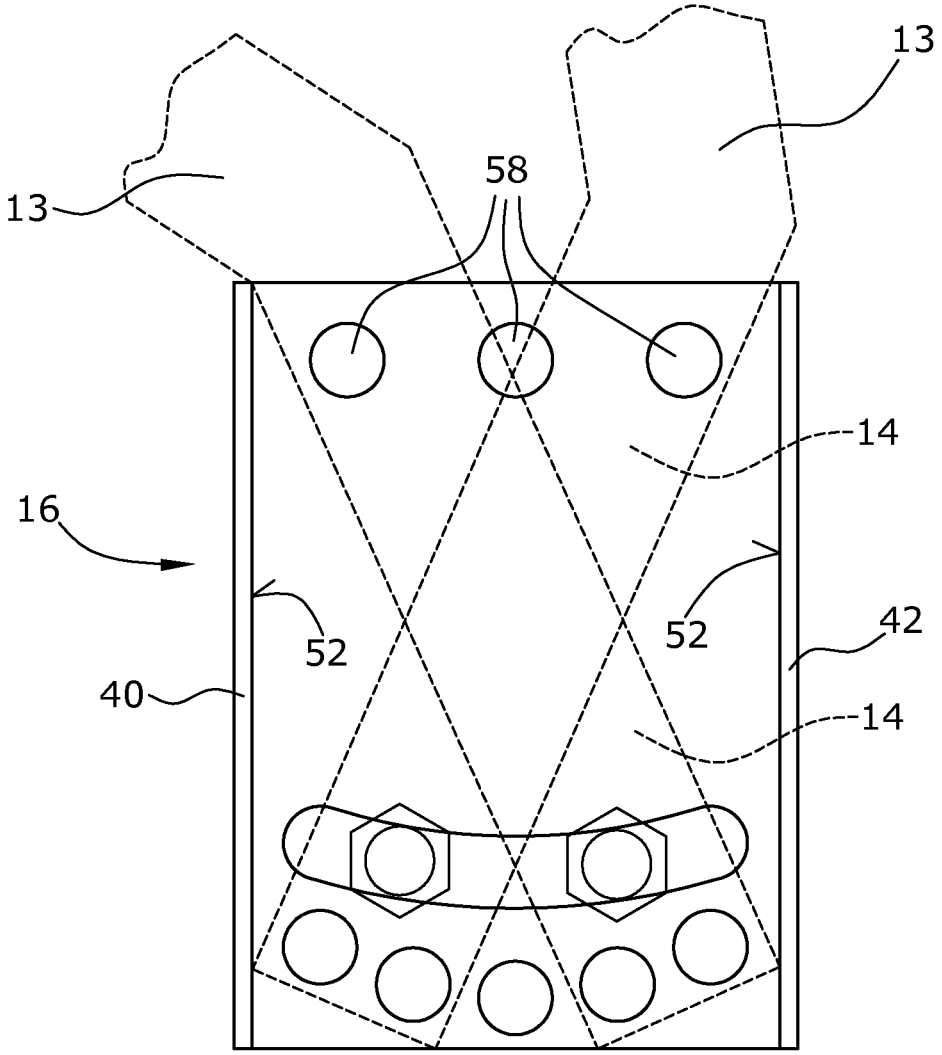
FIG. 5 is a side elevational view of the securing element of FIG. 2 together with a tow bar in different positions.
Figure 7:
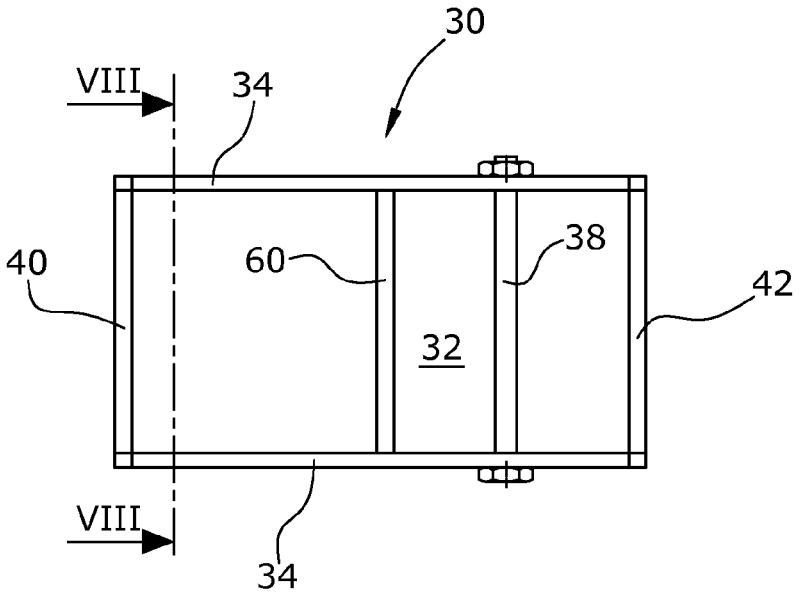
FIG. 7 is a top plan view of the securing element illustrated in FIG. 6, seen in the direction of the arrow VII.
Figure 8:
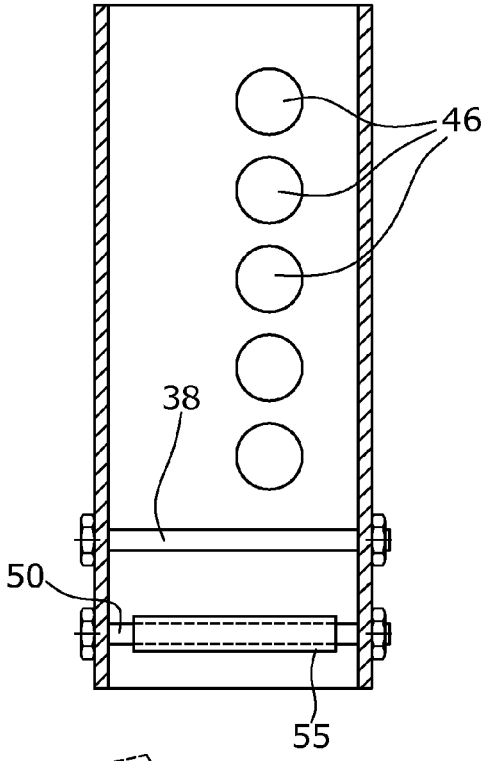
FIG. 8 is a sectional view of the securing element illustrated in FIG. 6, seen along the line VIII-VIII in FIG. 7.

This embodiment differs from the embodiment illustrated in FIGS. 2 to 4 basically by the fact that the side walls 34 in the rear portion, i.e. the portion averted from the stern 20 of the boat, are beveled. Thus, it is not the upper region of the rear wall 40 that serves as the rear upper stop element, but an additionally provided web 60 (FIG. 7). Further, in the embodiment illustrated herein, the rear wall 40 extends only to the beveled edge 62. In this regard, the receiving space 32 is open to the rear, i.e. opposite to the longitudinal direction of the boat. As can be seen in particular in FIG. 8, this has the advantage that the rear wall 42 can additionally be formed as a fixing element that corresponds to the fixing element 44 of the embodiment in FIGS. 2 to 4. Therefore, the rear wall 42 is provided with the bores 46 through which the screws for fastening to the engine plate 18 are inserted.

For the rest, the securing element 16 of this embodiment (FIGS. 6 to 8) has the same essential elements as the embodiment described with reference to FIGS. 2 to 4. In particular, a curved slot 36 and bores 56 are also provided in the two mutually opposite side walls 34.

Figure 10:
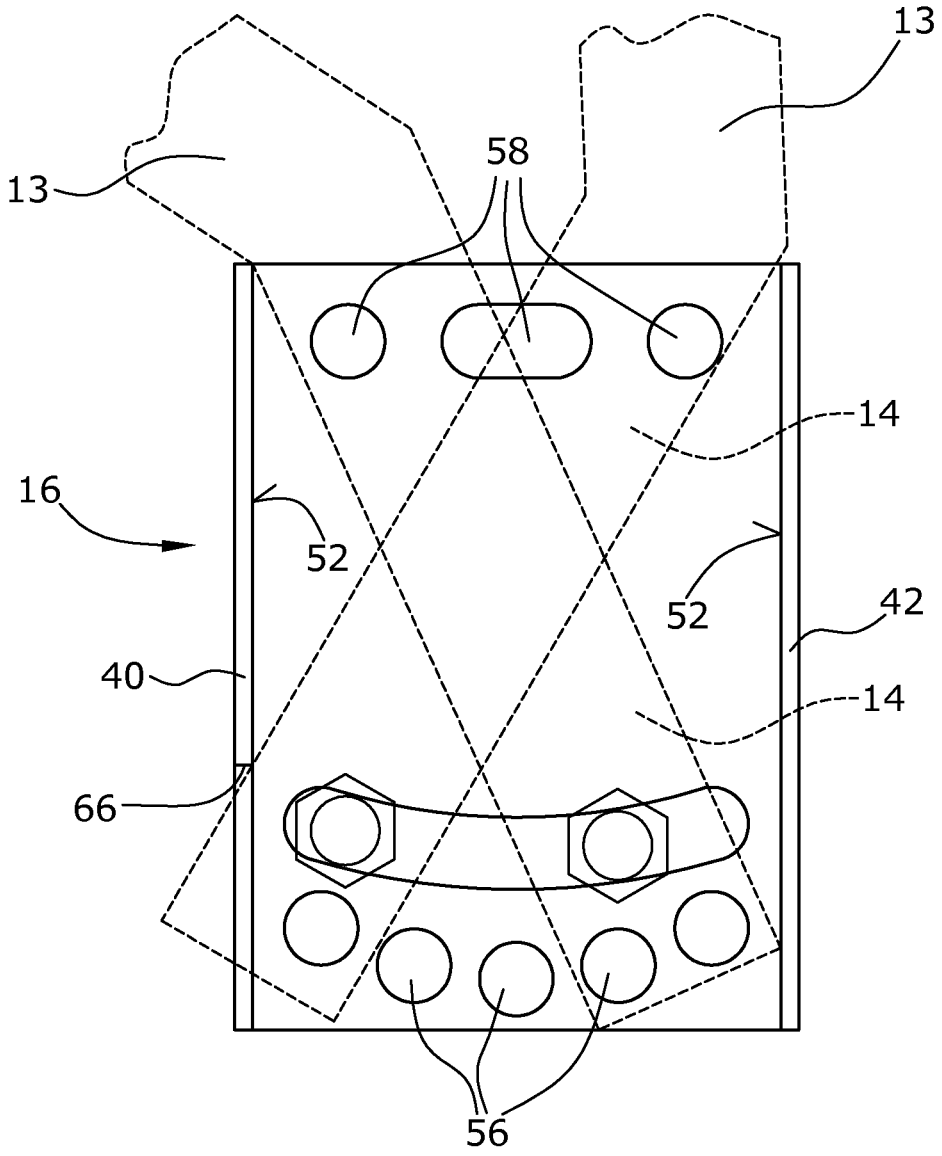
FIG. 10 is a schematical side elevational view of another embodiment of a securing element, together with a tow bar in different positions.

In the embodiment illustrated in FIG. 10, a securing element 16 is shown that is designed similar to the securing element illustrated in FIGS. 2 to 4. The only difference is that a recess 66 is provided in the lower region of the rear wall 40. Thereby, it is possible that in the highest position of the tow bar 10, the right position in FIG. 10, the lower end of the tow bar foot 14 protrudes from the receiving element 30. Thereby, the tilting range is further enlarged. In FIG. 10, an upper or high position of the tow bar is illustrated. The same is typically used to tow waterskiers or wakeboarders. In a lower or bottom position of the tow bar, the same serves in particular to tow heavy loads, such as boats or the like. The tow bar can be tilted upward from the lower position, as it can after a stop element has been provided.

Figure 12:
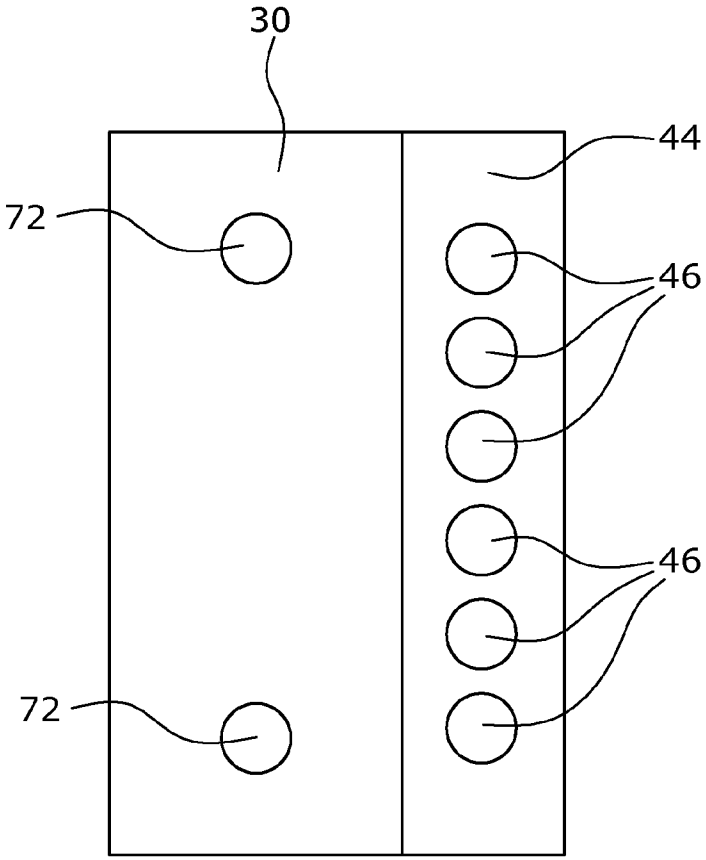
FIG. 12 is a schematical front view of the securing element illustrated in FIG. 11, seen in the direction of the arrow XII.
Figure 11:
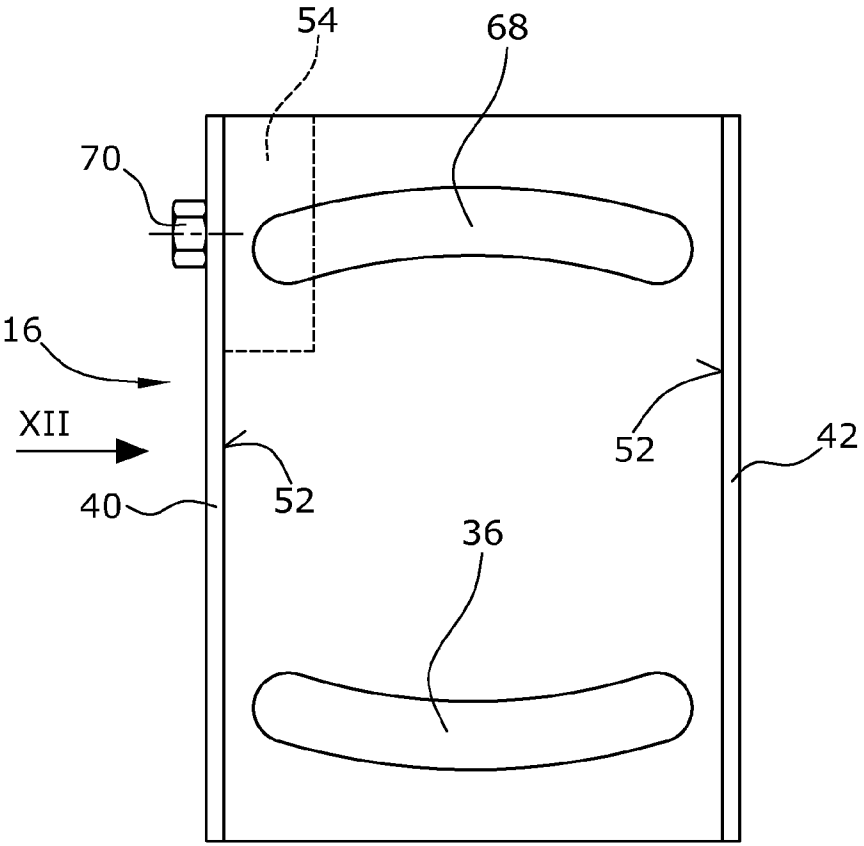
FIG. 11 is a schematical side elevational view of another embodiment of a securing element.

A further preferred embodiment is illustrated in FIGS. 11 and 12, in which similar and identical parts are again identified by the same reference numerals. The securing element 16 illustrated is a securing element that can be used both as a left and a right securing element. In this regard, the securing element has a partly symmetrical structure. In addition to the lower curved slot-shaped opening 36, an upper slot-shaped opening 68 symmetrical with respect to a centre line not illustrated.

Further, the fixing element 44 is provided with six bores 46 also arranged symmetrically with respect to a horizontal centre line. Thereby, it is possible to turn the element illustrated as the left securing element, seen from the rear of the boat, by 180° so that the fixing element 44 is arranged on the left side of the receiving element 30. Correspondingly, fastening is then effected via other bores 46 and the slot-shaped opening 68 then forms the lower opening.

In the embodiment illustrated in FIGS. 11 and 12, the stop element 54 is not glued in, but is fixed with a screw or a nut 70. In this regard, bores 72 are provided in the rear wall 40. Fastening the stop 54 with a screw or nut 70 has the advantage that the position of the stop 54 can be varied in a simple manner, depending on whether the securing element is used as the left or right securing element.

What is claimed is:

1. A tow bar holder for securing a tow bar to a boat having an outboard engine, comprising:

two separate securing elements secured to a stern of the boat, each securing element having a fixing element for securing the securing element to the stern of the boat, and a receiving element connected with the fixing element, the receiving element comprising a receiving space for inserting feet of the tow bar into the receiving space, wherein the receiving elements each comprise, so as to define the receiving space, two mutually parallel side walls extending in the longitudinal direction of the boat, a boat-side front wall, and a rear wall opposite the boat-side front wall, and wherein the receiving space is substantially rectangular, wherein the receiving space has a width extending between the pair of side walls and transversely to a longitudinal direction of the boat substantially and a length extending between the front and rear walls in the longitudinal direction of the boat, wherein the width corresponds to a width of a tow bar foot of the feet and the length is larger than a corresponding dimension of the tow bar foot such that the receiving space has internal dimensions that are larger than external dimensions of the feet of the tow bar and such that the feet are movable in the receiving space or are fixable in various positions in the receiving space.

2. The tow bar holder of claim 1, wherein at least one of the retaining elements is releasably connected with the receiving elements to prevent the feet of the tow bar from slipping out of the receiving spaces.

3. The tow bar holder of claim 2, wherein the retaining element is arranged transversely or longitudinally with respect to the receiving element.

4. The tow bar holder of claim 2, wherein the retaining element is adapted to be inserted into an opening in to one of the side walls of the receiving elements and an opening in the foot of the tow bar.

5. The tow bar holder of claim 2, wherein the retaining element is adapted to be inserted into a front tow bar wall and/or a rear tow bar wall in the foot of the tow bar.

6. The tow bar holder of claim 4, wherein the opening is formed slot-shaped in the receiving element, and identical slot-shaped openings are provided in the two mutually opposite side walls or the rear wall and the boat-side front wall of the receiving elements.

7. The tow bar holder of claim 1, wherein the receiving element comprises at least one stop element restricting the tiltability in the longitudinal direction.

8. The tow bar holder of claim 7 wherein the at least one stop element is an upper stop element and/or a lower stop element.

9. The tow bar holder of claim 7, wherein the at least one stop element is formed at least in part by the boat-side front wall or the rear wall of the receiving space.

10. The tow bar holder of claim 7, wherein the at least one stop element is at least partly adjustable.

11. The tow bar holder of claim 7, wherein the at least one stop element is at least partly designed as a stop pin that is adapted to be fixed in upper and/or lower bores provided in the side walls of the receiving element.

12. The tow bar holder of claim 1, wherein the fixing element is laterally offset from the receiving element.

13. The tow bar holder of claim 1, wherein the fixing element is formed integrally with the boat-side front wall of the receiving element.

14. The tow bar holder of claim 1, wherein the fixing element is offset with respect to the boat-side front wall of the receiving element.

15. The tow bar holder of claim 12, wherein the fixing element has a lower and/or upper region provided with a recess for the retaining element and/or a stop pin.

16. The tow bar holder of claim 1, further comprising a rear wall averted from the boat has a recess in a lower region for enlarging a maximum tilting range of the tow bar.

17. The tow bar holder of claim 7, wherein the at least one stop element is connected with damping elements.

* * * * *